US009310735B2

(12) United States Patent
Yamaguchi et al.

(10) Patent No.: US 9,310,735 B2
(45) Date of Patent: Apr. 12, 2016

(54) FIXING DEVICE AND IMAGE FORMING APPARATUS HAVING TEMPERATURE DETECTOR

(71) Applicants: Yoshiki Yamaguchi, Kanagawa (JP); Kazuhito Kishi, Kanagawa (JP); Masahiro Samei, Osaka (JP); Ippei Fujimoto, Kanagawa (JP); Misaki Shimizu, Tokyo (JP); Yukiko Nakajima, Kanagawa (JP); Keisuke Kawabata, Kanagawa (JP)

(72) Inventors: Yoshiki Yamaguchi, Kanagawa (JP); Kazuhito Kishi, Kanagawa (JP); Masahiro Samei, Osaka (JP); Ippei Fujimoto, Kanagawa (JP); Misaki Shimizu, Tokyo (JP); Yukiko Nakajima, Kanagawa (JP); Keisuke Kawabata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/484,769

(22) Filed: Sep. 12, 2014

(65) Prior Publication Data

US 2015/0078768 A1 Mar. 19, 2015

(30) Foreign Application Priority Data

Sep. 17, 2013 (JP) ..... 2013-191849
Jul. 7, 2014 (JP) ..... 2014-139359

(51) Int. Cl.
*G03G 15/20* (2006.01)

(52) U.S. Cl.
CPC ..... *G03G 15/2064* (2013.01); *G03G 15/2053* (2013.01); *G03G 2215/2019* (2013.01); *G03G 2215/2035* (2013.01)

(58) Field of Classification Search
CPC ..... G03G 15/2067; G03G 21/1685; G03G 2215/2016; G03G 2215/2035; G03G 2215/2019; G03G 15/2064; G03G 15/2053
USPC ..... 399/122, 329
See application file for complete search history.

(56) References Cited

U.S. PATENT DOCUMENTS

| | | | | |
|---|---|---|---|---|
| 6,456,819 | B1 * | 9/2002 | Abe et al. | 399/329 |
| 7,427,727 | B2 * | 9/2008 | Koide et al. | 219/216 |
| 7,773,930 | B2 * | 8/2010 | Shin et al. | 399/329 |
| 8,107,868 | B2 * | 1/2012 | Kimura | 399/329 |
| 2006/0269308 | A1 * | 11/2006 | Ishii | G03G 15/2039 399/69 |
| 2011/0058862 | A1 | 3/2011 | Yamaguchi et al. | |
| 2011/0229181 | A1 * | 9/2011 | Iwaya et al. | 399/69 |
| 2012/0163885 | A1 * | 6/2012 | Ishida | 399/329 |

FOREIGN PATENT DOCUMENTS

| | | |
|---|---|---|
| JP | 6-095540 | 4/1994 |
| JP | 2001-343860 | 12/2001 |
| JP | 2005-181946 | 7/2005 |
| JP | 2012-189770 | 10/2012 |

* cited by examiner

*Primary Examiner* — Clayton E Laballe
*Assistant Examiner* — Trevor J Bervik
(74) *Attorney, Agent, or Firm* — Oblon, McClelland, Maier & Neustadt, L.L.P.

(57) ABSTRACT

A fixing device includes a fixing rotator formed into a loop and rotatable in a predetermined direction of rotation and a pressure rotator disposed outside the loop formed by the fixing rotator and pressed against the fixing rotator to form a fixing nip therebetween through which a recording medium bearing a toner image is conveyed. A stay is disposed opposite the pressure rotator via the fixing rotator. A heater is disposed opposite an inner circumferential surface of the fixing rotator to heat the fixing rotator. A pressurization member is pressed against the heater via the fixing rotator. A housing is interposed between the stay and the heater. A temperature detector is mounted on the housing to detect a temperature of the heater.

20 Claims, 9 Drawing Sheets

FIXING DEVICE AND IMAGE FORMING APPARATUS HAVING TEMPERATURE DETECTOR

CROSS-REFERENCE TO RELATED APPLICATIONS

This patent application is based on and claims priority pursuant to 35 U.S.C. §119 to Japanese Patent Application Nos. 2013-191849, filed on Sep. 17, 2013, and 2014-139359, filed on Jul. 7, 2014, in the Japanese Patent Office, the entire disclosure of each of which is hereby incorporated by reference herein.

BACKGROUND

1. Technical Field

Exemplary aspects of the present invention relate to a fixing device and an image forming apparatus, and more particularly, to a fixing device for fixing an image on a recording medium and an image forming apparatus incorporating the fixing device.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing sleeve, a fixing belt, and a fixing film, heated by a heater and a pressure rotator, such as a pressure roller and a pressure belt, pressed against the fixing rotator to form a fixing nip therebetween. As a recording medium bearing a toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing rotator formed into a loop and rotatable in a predetermined direction of rotation and a pressure rotator disposed outside the loop formed by the fixing rotator and pressed against the fixing rotator to form a fixing nip therebetween through which a recording medium bearing a toner image is conveyed. A stay is disposed opposite the pressure rotator via the fixing rotator. A heater is disposed opposite an inner circumferential surface of the fixing rotator to heat the fixing rotator. A pressurization member is pressed against the heater via the fixing rotator. A housing is interposed between the stay and the heater. A temperature detector is mounted on the housing to detect a temperature of the heater.

This specification further describes an improved image forming apparatus. In one exemplary embodiment, the image forming apparatus includes an image forming device to form a toner image and a fixing device, disposed downstream from the image forming device in a recording medium conveyance direction, to fix the toner image on a recording medium. The fixing device includes a fixing rotator formed into a loop and rotatable in a predetermined direction of rotation and a pressure rotator disposed outside the loop formed by the fixing rotator and pressed against the fixing rotator to form a fixing nip therebetween through which the recording medium bearing the toner image is conveyed. A stay is disposed opposite the pressure rotator via the fixing rotator. A heater is disposed opposite an inner circumferential surface of the fixing rotator to heat the fixing rotator. A pressurization member is pressed against the heater via the fixing rotator. A housing is interposed between the stay and the heater. A temperature detector is mounted on the housing to detect a temperature of the heater.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
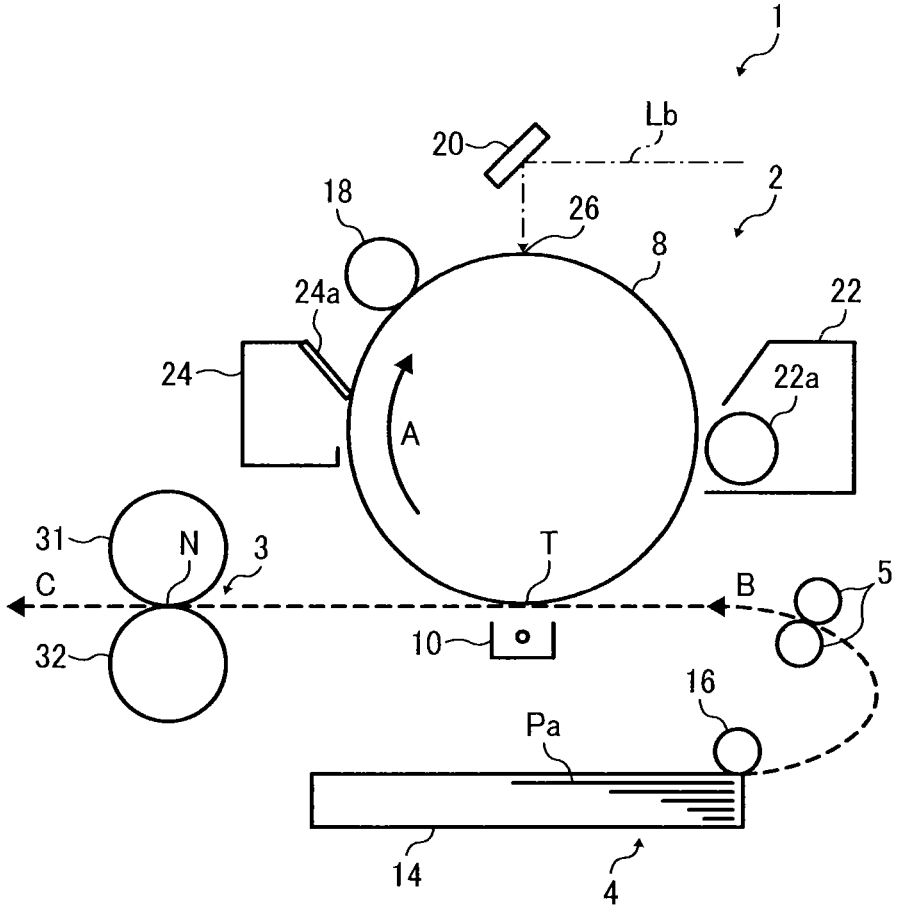
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a printer that forms a monochrome toner image on a recording medium by electrophotography.

With reference to FIG. 1, a description is provided of a construction of the image forming apparatus 1.

The image forming apparatus 1 is a monochrome printer for forming a monochrome toner image on a recording medium by electrophotography. Alternatively, the image forming apparatus 1 may be a color printer for forming a color toner image on a recording medium. The image forming apparatus 1 includes a sheet feeder 4, a registration roller pair 5, an image forming device 2, and a fixing device 3 arranged in this order in sheet conveyance directions B and C.

A detailed description is now given of a construction of the image forming device 2.

The image forming device 2 includes a photoconductive drum 8 serving as an image carrier. The photoconductive drum 8 is surrounded by a charging roller 18 serving as a charger, a mirror 20, a development device 22, a transfer charger 10 serving as a transfer device, and a cleaner 24 (e.g., a cleaning unit), which are arranged in this order in a rotation direction A of the photoconductive drum 8.

The mirror 20, constituting a component of an exposure device, reflects a light beam Lb emitted by the exposure device onto an exposure position 26 on an outer circumferential surface of the photoconductive drum 8 interposed between the charging roller 18 and the development device 22 in the rotation direction A of the photoconductive drum 8, thus forming an electrostatic latent image on the photoconductive drum 8.

The development device 22 contains toner and includes a development roller 22*a* that supplies toner to the outer circumferential surface of the photoconductive drum 8. According to this exemplary embodiment, the development device 22 contains black toner to form a black toner image. Alternatively, the development device 22 may contain toner in other colors, for example, yellow, cyan, magenta, and the like.

The cleaner 24 (e.g., a cleaning unit) includes a cleaning blade 24*a* that removes residual toner failed to be transferred onto a sheet Pa and therefore remaining on the photoconductive drum 8 therefrom.

A detailed description is now given of a construction of the fixing device 3.

The fixing device 3 includes a fixing sleeve 31 serving as a tubular fixing rotator made of heat resistant resin, a pressure roller 32 serving as a pressure rotator, and a heater that heats the fixing sleeve 31. The pressure roller 32 is pressed against the fixing sleeve 31 to form a fixing nip N therebetween.

A detailed description is now given of a construction of the sheet feeder 4.

The sheet feeder 4 includes a paper tray 14 that loads a plurality of sheets Pa serving as recording media and a feed roller 16 that picks up and feeds an uppermost sheet Pa of the plurality of sheets Pa loaded in the paper tray 14. A conveyance roller pair conveys the uppermost sheet Pa conveyed from the feed roller 16 to the registration roller pair 5.

A detailed description is now given of a configuration of the registration roller pair 5.

As a leading edge of the uppermost sheet Pa comes into contact with a roller nip of the registration roller pair 5, the registration roller pair 5 halts the sheet Pa temporarily. After the registration roller pair 5 corrects skew of the sheet Pa, the registration roller pair 5 resumes its rotation and feeds the sheet Pa in the sheet conveyance direction B to a transfer nip T formed between the photoconductive drum 8 and the transfer charger 10 in synchronism with rotation of the photoconductive drum 8. For example, at a time when a leading edge of the toner image formed on the photoconductive drum 8 corresponds to a predetermined position on the leading edge of the sheet Pa, the sheet Pa enters the transfer nip T.

A description is provided of an image forming operation of the image forming apparatus 1 to form a toner image on a sheet Pa.

As the photoconductive drum 8 starts rotating in the rotation direction A, the charging roller 18 uniformly charges the outer circumferential surface of the photoconductive drum 8. The exposure device emits a laser beam Lb modulated in accordance with image data sent from an external device such as a client computer onto the charged outer circumferential surface of the photoconductive drum 8 at the exposure position 26 thereon. The laser beam Lb scans the photoconductive drum 8 in a main scanning direction parallel to an axial direction of the photoconductive drum 8, thus forming an electrostatic latent image to be visualized into a toner image on the outer circumferential surface of the photoconductive drum 8.

The electrostatic latent image formed on the photoconductive drum 8 moves to a development position disposed opposite the development roller 22*a* of the development device 22 in accordance with rotation of the photoconductive drum 8. At the development position, the development roller 22*a* supplies toner to the electrostatic latent image on the photoconductive drum 8, visualizing the electrostatic latent image into a toner image. The transfer charger 10 applied with a transfer bias transfers the toner image from the photoconductive drum 8 onto a sheet Pa at a predetermined time when the sheet Pa enters the transfer nip T.

The sheet Pa bearing the toner image is conveyed in the sheet conveyance direction B to the fixing device 3. As the sheet Pa is conveyed through the fixing nip N formed between the fixing sleeve 31 and the pressure roller 32, the fixing sleeve 31 and the pressure roller 32 apply heat and pressure to the sheet Pa, fixing the toner image on the sheet Pa. The sheet Pa bearing the fixed toner image is conveyed in the sheet conveyance direction C to an output tray that stacks the sheet Pa.

As residual toner failed to be transferred onto the sheet Pa at the transfer nip T and therefore remaining on the photoconductive drum 8 moves under the cleaner 24 in accordance with rotation of the photoconductive drum 8, the cleaning blade 24*a* scrapes the residual toner off the photoconductive drum 8, thus cleaning the photoconductive drum 8. Thereafter, a discharger (e.g., a discharging lamp) removes residual potential from the photoconductive drum 8, rendering the photoconductive drum 8 to be ready for a next image forming operation.

Figure 2:
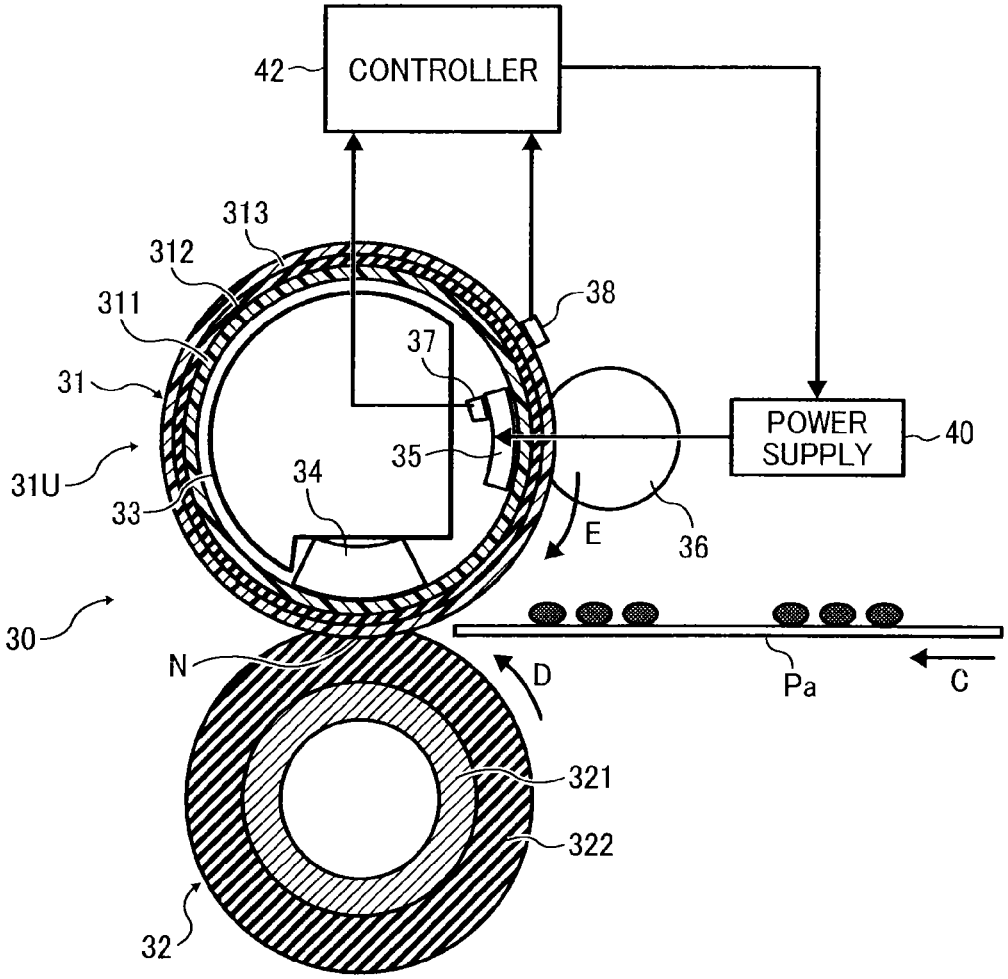
FIG. 2 is a schematic vertical sectional view of a fixing device installable in the image forming apparatus shown in FIG. 1.

With reference to FIG. 2, a description is provided of a construction of a fixing device 30 installable in the image forming apparatus 1 described above.

FIG. 2 is a schematic vertical sectional view of the fixing device 30. As shown in FIG. 2, the fixing device 30 (e.g., a fuser) includes the fixing sleeve 31 serving as a thin, tubular fixing rotator rotatable in a rotation direction E and the pressure roller 32 serving as a pressure rotator rotatable in a rotation direction D and pressed against the fixing sleeve 31 to form the fixing nip N therebetween. The fixing sleeve 31 is heated by an interior heater disposed inside a loop formed by the fixing sleeve 31.

A detailed description is now given of a construction of the fixing sleeve 31.

The fixing sleeve 31 is constructed of a base layer 311, an elastic layer 312 coating the base layer 311, and a release layer 313 coating the elastic layer 312. The base layer 311, made of heat resistant resin, for example, polyimide resin, has an outer diameter of about 30 mm and a thickness of about 50 micrometers. The elastic layer 312, made of heat resistant elastic material, for example, silicone rubber, has a thickness in a range of from about 50 micrometers to about 70 micrometers. The release layer 313, having a thickness in a range of from about 5 micrometers to about 50 micrometers, is made of fluoroplastic such as tetrafluoroethylene-perfluoroalkylvinylether copolymer (PFA) and polytetrafluoroethylene (PTFE) to enhance durability of the fixing sleeve 31 and facilitate separation of toner of the toner image on the sheet Pa from the fixing sleeve 31. Compared to the outer diameter of the fixing sleeve 31, the thickness of each of the base layer 311, the elastic layer 312, and the release layer 313 is substantially small. However, in FIG. 2, the thickness of each of the base layer 311, the elastic layer 312, and the release layer 313 is exaggerated for purposes of illustration. Alternatively, the base layer 311 may be made of metal such as SUS stainless steel and nickel.

Inside the loop formed by the fixing sleeve 31 are a support 33 that supports the fixing sleeve 31 and also serves as a guide that guides the fixing sleeve 31 by contacting an inner circumferential surface of the fixing sleeve 31, a nip formation pad 34 pressing against the pressure roller 32 via the fixing sleeve 31 to form the fixing nip N, and a planar heater 35, serving as a heater, shifted from the fixing nip N in a circumferential direction of the fixing sleeve 31 by about 90 degrees. The planar heater 35 includes a heat generation face that contacts the inner circumferential surface of the fixing sleeve 31 to heat the fixing sleeve 31. The support 33 is formed in substantially a tube constructed of an arch curved along the inner circumferential surface of the fixing sleeve 31, a horizontal plate disposed opposite the nip formation pad 34, and a vertical plate disposed opposite the planar heater 35. The support 33 is made of heat resistant resin, metal such as stainless steel, or the like.

The support 33, the nip formation pad 34, and the planar heater 35 are mounted on side plates through flanges that rotatably support the fixing sleeve 31 by contacting the inner circumferential surface of the fixing sleeve 31, respectively. An outer face of each of the support 33, the nip formation pad 34, and the planar heater 35 that contacts the inner circumferential surface of the fixing sleeve 31 may be coated with abrasion resistant fluoroplastic having a decreased friction coefficient such as PFA and PTFE.

A detailed description is now given of a construction of the pressure roller 32.

The pressure roller 32, having an outer diameter of about 30 mm, is constructed of a core metal 321 and an elastic layer 322 coating the core metal 321. The core metal 321, made of iron, has a thickness of about 2 mm. The elastic layer 322, made of silicone rubber, has a thickness of about 5 mm. A fluoroplastic layer having a thickness of about 40 micrometers may coat the elastic layer 322 to facilitate separation of the sheet Pa from the pressure roller 32.

A resilient pressurization assembly presses the pressure roller 32 against the nip formation pad 34 via the fixing sleeve 31. For example, as the elastic layer 322 of the pressure roller 32 is pressed against the fixing sleeve 31, a part of the elastic layer 322 disposed opposite the nip formation pad 34 deforms throughout an axial span of the pressure roller 32 in an axial direction thereof, forming the fixing nip N having a predetermined length in the rotation direction D of the pressure roller 32. While the pressure roller 32 is pressed against the fixing sleeve 31, a driver drives and rotates the pressure roller 32 counterclockwise in FIG. 2 in the rotation direction D. In accordance with rotation of the pressure roller 32, the fixing sleeve 31 is rotated clockwise in FIG. 2 in the rotation direction E by friction between the fixing sleeve 31 and the pressure roller 32.

A rotatable pressurization roller 36 situated outside the loop formed by the fixing sleeve 31 is disposed opposite the planar heater 35 via the fixing sleeve 31. A resilient pressurization assembly presses a shaft of the pressurization roller 36 against the fixing sleeve 31, thus pressing the fixing sleeve 31 against the planar heater 35. At least a portion of the pressurization roller 36 in proximity to an outer circumferential surface thereof has elasticity so that a part of the pressurization roller 36 pressed against the fixing sleeve 31 is pressed and deformed to allow the pressurization roller 36 to rotate in accordance with rotation of the fixing sleeve 31 by friction therebetween.

The planar heater 35 mounts a temperature detector 37 (e.g., a thermistor) that detects the temperature of the planar heater 35. The fixing sleeve 31 and the components disposed inside the loop formed by the fixing sleeve 31, that is, the planar heater 35, the temperature detector 37, the support 33, and the nip formation pad 34, may constitute a belt unit 31U separably coupled with the pressure roller 32. Upstream from the planar heater 35 in the rotation direction E of the fixing sleeve 31 is a temperature detector 38 (e.g., a thermistor) disposed outside the loop formed by the fixing sleeve 31. The temperature detector 38, disposed opposite an outer circumferential surface of the fixing sleeve 31, detects the temperature of the outer circumferential surface of the fixing sleeve 31. The fixing device 30 further includes a power supply 40 that supplies power to the planar heater 35 and a controller 42 operatively connected to the power supply 40 and the temperature detectors 37 and 38 to control the power supply 40 based on the temperature of the planar heater 35 detected by the temperature detector 37 and the temperature of the fixing sleeve 31 detected by the temperature detector 38. Alternatively, the controller 42 and the power supply 40 may be situated in the image forming apparatus 1 at a position outside the fixing device 3.

A detailed description is now given of a configuration of the controller 42.

The controller 42 (e.g., a processor) is a micro computer including a central processing unit (CPU), a read-only memory (ROM), a random-access memory (RAM), and an input-output (I/O) interface. The controller 42 controls the power supply 40 to adjust an amount of power supplied to the planar heater 35 so that the temperature of the outer circumferential surface of the fixing sleeve 31 detected by the temperature detector 38 maintains a predetermined fixing temperature at which the toner image is fixed on the sheet Pa properly. Thus, the controller 42 controls the temperature of the planar heater 35 based on the temperature of the planar heater 35 detected by the temperature detector 37. A sheet Pa bearing an unfixed toner image illustrated by the solid circles in FIG. 2 is conveyed to the fixing nip N formed between the fixing sleeve 31 and the pressure roller 32 pressed against the fixing sleeve 31. As the pressure roller 32 rotating in the rotation direction D and the fixing sleeve 31 rotating in the rotation direction E by friction between the pressure roller 32 and the fixing sleeve 31 sandwich and convey the sheet Pa through the fixing nip N, the fixing sleeve 31 contacting the toner image on the sheet Pa, together with the pressure roller 32, applies heat and pressure to the sheet Pa, fixing the toner image on the sheet Pa. Thereafter, the sheet Pa bearing the fixed toner image is discharged from the fixing nip N leftward in FIG. 2.

Figure 3:
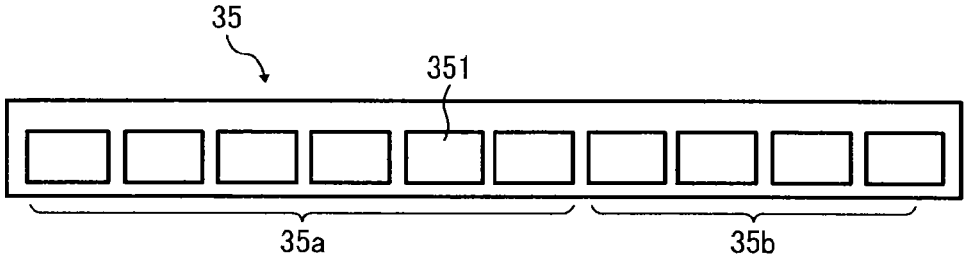
FIG. 3 is a plan view of a planar heater incorporated in the fixing device shown in FIG. 2.

With reference to FIG. 3, a description is provided of a construction of the planar heater 35.

FIG. 3 is a plan view of the planar heater 35. As shown in FIG. 3, the planar heater includes a plurality of heating portions 351, that is, ten heating portions 351 according to this exemplary embodiment, aligned in an axial direction, that is, a longitudinal direction, of the fixing sleeve 31 perpendicular to the sheet conveyance direction C. The plurality of heating portions 351 constitutes heating spans 35*a* and 35*b* in the axial direction of the fixing sleeve 31. The controller 42 actuates each heating portion 351 independently to heat the fixing sleeve 31 in a variable heating span in the axial direction thereof. For example, the controller 42 controls the power supply 40 to selectively supply power to the heating portions situated in the heating span 35*a* or 35*b*. Alternatively, the controller 42 may control the power supply 40 to supply power to the heating portions 351 situated in the heating span 35*a* in a first amount of power and to the heating portions 351 situated in the heating span 35*b* in a second amount of power different from the first amount of power so as to allow the planar heater 35 to generate heat in the heating spans 35*a* and 35*b* in different amounts of heat, respectively.

The controller 42 actuates the heating portions 351 of the planar heater 35 in the heating span 35*a* independently from the heating portions 351 in the heating span 35*b* based on position data of the toner image formed on the sheet Pa to allow the heating portions 351 corresponding to a blank area on the sheet Pa to heat the fixing sleeve 31 to a temperature lower than a temperature to which the heating portions 351 corresponding to an image area on the sheet Pa heat the fixing sleeve 31, thus heating the fixing sleeve 31 unevenly in the axial direction thereof.

With reference to FIGS. 4A, 4B, 5A, and 5B, a description is provided of one example of control performed by the controller 42.

Figure 4A:
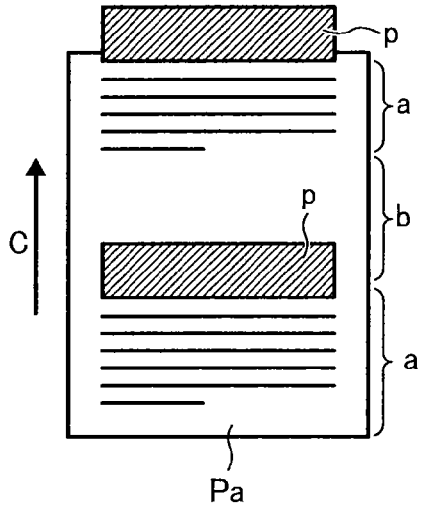
FIG. 4A is a plan view of a sheet conveyed through the fixing device shown in FIG. 2 and having a first image formation pattern.
Figure 4B:
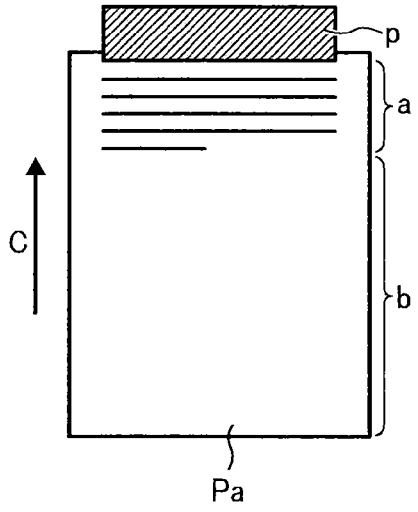
FIG. 4B is a plan view of a sheet conveyed through the fixing device shown in FIG. 2 and having a second image formation pattern.

FIG. 4A is a plan view of a sheet Pa having a first image formation pattern. FIG. 4A illustrates the first image formation pattern having an image area a, a blank area b, and an image area a arranged on the sheet Pa in this order from a leading edge to a trailing edge of the sheet Pa in the sheet conveyance direction C. FIG. 4B is a plan view of a sheet Pa having a second image formation pattern. FIG. 4B illustrates the second image formation pattern having an image area a and a blank area b arranged on the sheet Pa in this order from the leading edge to the trailing edge of the sheet Pa in the sheet conveyance direction C. The blank area b is greater than the image area a. The image area a, as it bears the toner image, needs fixing of the toner image on the sheet Pa. Conversely, the blank area b, as it does not bear the toner image, does not need fixing of the toner image on the sheet Pa.

As an image processor sends image data having the first image formation pattern shown in FIG. 4A or the second image formation pattern shown in FIG. 4B to the controller 42, the controller 42 performs a control below. As shown in FIGS. 2 and 3, the controller 42 controls the planar heater 35 to cause the heating portions 351 disposed opposite a non-image region on the fixing sleeve 31 corresponding to the blank area b on the sheet Pa to heat the fixing sleeve 31 to a decreased temperature and cause the heating portions 351 disposed opposite an image region on the fixing sleeve 31 corresponding to the image area a on the sheet Pa to heat the fixing sleeve 31 to an increased temperature higher than the decreased temperature. The non-image region on the fixing sleeve 31 adheres to the blank area b on the sheet Pa conveyed through the fixing nip N; the image region on the fixing sleeve 31 adheres to the image area a on the sheet Pa conveyed through the fixing nip N.

For example, when the image area a on the sheet Pa is conveyed through the fixing nip N, the controller 42 controls the power supply 40 to supply power to the planar heater 35 in an increased amount great enough to allow the heating portions 351 to heat the fixing sleeve 31 to the fixing temperature throughout the entire span in the axial direction thereof. Conversely, when the blank area b on the sheet Pa is conveyed through the fixing nip N, the controller 42 controls the power supply 40 to supply power to the planar heater 35 in a decreased amount great enough to allow the heating portions 351 to heat the fixing sleeve 31 to a temperature lower than the fixing temperature. When the image area a in proximity to the trailing edge of the sheet Pa is conveyed through the fixing nip N, the controller 42 controls the power supply 40 to supply power to the planar heater 35 in the increased amount great enough to allow the heating portions 351 to heat the fixing sleeve 31 to the fixing temperature throughout the entire span in the axial direction thereof.

The controller 42 controls the power supply 40 to supply power to the planar heater 35 such that the planar heater 35 preliminarily heats a preliminary heating region on the fixing sleeve 31 corresponding to a preliminary heating area p indicated by shading in FIGS. 4A and 4B on the sheet Pa or spanning across the leading edge of the sheet Pa in the sheet conveyance direction C. The preliminary heating area p on the sheet Pa enters the fixing nip N before the image area a on the sheet Pa does. The preliminary heating area p is provided in view of a circumferential heat generation span of the planar heater 35 in a circumferential direction thereof and a time needed for the heating portions 351 to heat themselves. The preliminary heating area p may be as small as feasible in view of energy saving.

Figure 5A:
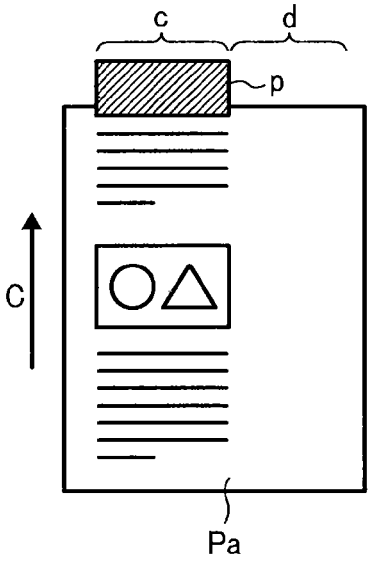
FIG. 5A is a plan view of a sheet conveyed through the fixing device shown in FIG. 2 and having a third image formation pattern.

FIG. 5A is a plan view of a sheet Pa having a third image formation pattern. FIG. 5A illustrates the third image formation pattern having an image area c and a blank area d arranged on the sheet Pa in the axial direction of the fixing sleeve 31 perpendicular to the sheet conveyance direction C. Like the sheet Pa having the first and second image formation patterns shown in FIGS. 4A and 4B, respectively, the controller 42 controls the planar heater 35 to heat the fixing sleeve 31 unevenly such that a temperature of a non-image region on the fixing sleeve 31 corresponding to the blank area d on the sheet Pa is lower than a temperature of an image region on the fixing sleeve 31 corresponding to the image area c on the sheet Pa.

For example, the controller 42 controls the planar heater 35 to supply power to the heating portions 351 in the heating span 35*a* depicted in FIG. 3 that are disposed opposite the image region on the fixing sleeve 31 corresponding to the image area c on the sheet Pa in an increased amount great enough to heat the fixing sleeve 31 to the fixing temperature. Conversely, the controller 42 controls the planar heater 35 to supply power to the heating portions 351 in the heating span 35*b* depicted in FIG. 3 that are disposed opposite the non-image region on the fixing sleeve 31 corresponding to the blank area d on the sheet Pa in a decreased amount great enough to heat the fixing sleeve 31 to a temperature lower than the fixing temperature. In this case also, the planar heater 35 heats the fixing sleeve 31 in a region thereon corresponding to the preliminary heating area p on the sheet Pa.

Figure 5B:
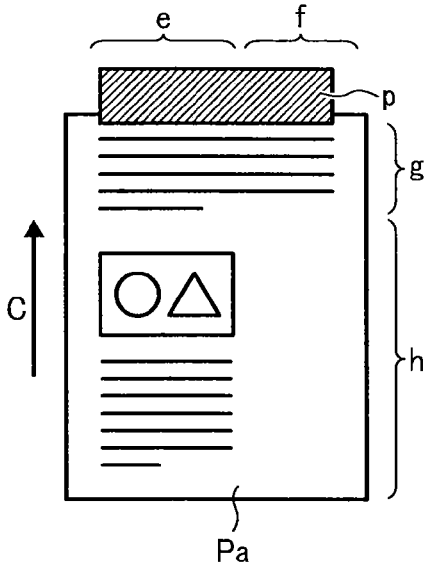
FIG. 5B is a plan view of a sheet conveyed through the fixing device shown in FIG. 2 and having a fourth image formation pattern.

FIG. 5B is a plan view of a sheet Pa having a fourth image formation pattern. FIG. 5B illustrates the fourth image formation pattern having axial image spans e and f in the axial direction of the fixing sleeve 31. The axial image span e includes image areas g and h arranged in the sheet conveyance direction C. The axial image span f includes the image area g and does not include the image area h. That is, the axial image span f includes a blank area adjacent to the image area h in the axial direction of the fixing sleeve 31.

The controller 42 may prohibit the power supply 40 from supplying power to the heating portions 351 disposed opposite the non-image regions on the fixing sleeve 31 corresponding to the blank areas b and d and the blank area adjacent to the image area h in the axial direction of the fixing sleeve 31. However, if the temperature of the fixing sleeve 31 is lowered excessively, the fixing sleeve 31 has not been heated to the fixing temperature when the subsequent image area a, c, g, or h on the sheet Pa comes into contact with the fixing sleeve 31.

Figure 6:
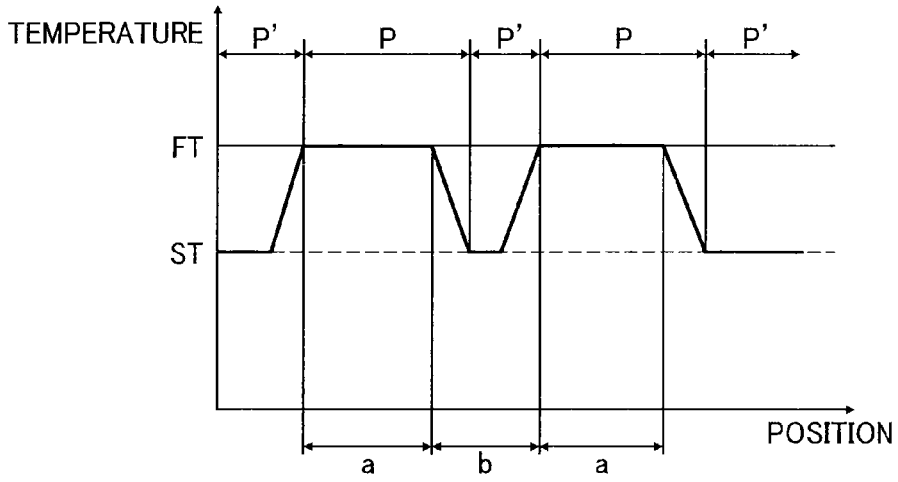
FIG. 6 is a graph showing a relation between the position on a fixing sleeve incorporated in the fixing device shown in FIG. 2 and the temperature of the fixing sleeve.

To address this circumstance, the controller 42 controls the planar heater 35 as shown in FIG. 6. FIG. 6 is a graph showing a relation between the position on the fixing sleeve 31 and the temperature of the fixing sleeve 31. As shown in FIG. 6, the controller 42 controls the planar heater 35 to retain the non-image region on the fixing sleeve 31 corresponding to the blank area b on the sheet Pa at a second target temperature ST that is lower than a first target temperature FT at which the image region on the fixing sleeve 31 corresponding to the image area a on the sheet Pa is heated and is higher than an ambient temperature by a predetermined temperature or more. Thus, although the power supply 40 supplies power P' to the heating portions 351 disposed opposite the non-image region on the fixing sleeve 31 corresponding to the blank area b on the sheet Pa as well as power P to the heating portions disposed opposite the image region on the fixing sleeve 31 corresponding to the image area a on the sheet Pa, the power supply 40 supplies a reduced amount of power to the heating portions 351, saving energy.

As shown in FIG. 2, since the thin, tubular fixing sleeve 31 is formed into the loop that produces a small space inside it, it may be difficult to position the temperature detector 37 that detects the temperature of the planar heater 35 precisely with respect to the planar heater 35. Further, as the temperature of the planar heater 35 and the support 33 changes or as the pressurization roller 36 presses against the planar heater 35, the temperature detector 37 may be displaced with respect to the planar heater 35 imprecisely, degrading precision in temperature detection. To address this circumstance, the temperature detector 37 serving as a safety device for the planar heater 35 may be secured by a securing mechanism described below.

With reference to FIGS. 7 to 14, a description is provided of the securing mechanism for securing the temperature detector 37 or a thermostat 48 described below with respect to the planar heater 35.

Figure 7:
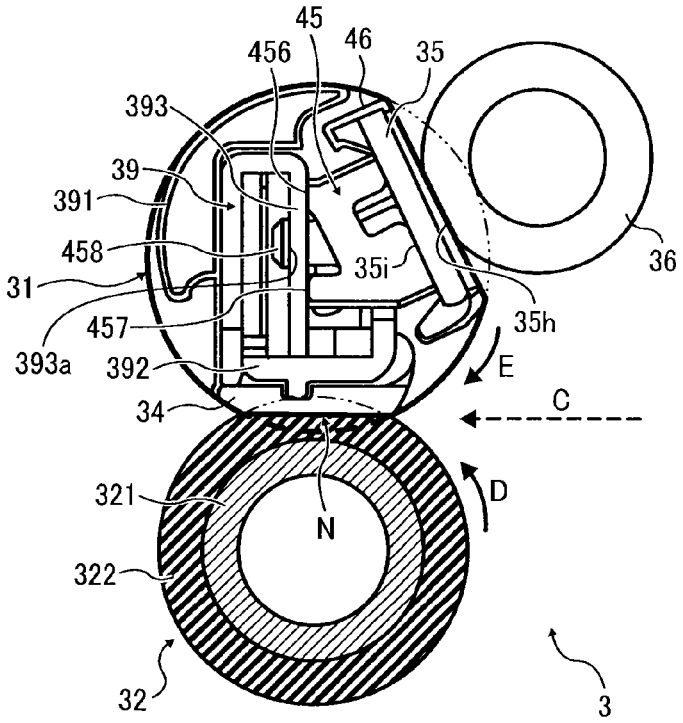
FIG. 7 is a schematic vertical sectional view of a fixing device incorporated in the image forming apparatus shown in FIG. 1.

It is to be noted that identical reference numerals are assigned to components shown in FIGS. 7 to 14 that are identical to the components shown in FIG. 2 and description of the identical components is omitted. FIG. 7 is a schematic vertical sectional view of the fixing device 3 incorporating the securing mechanism.

Like the fixing device 30 depicted in FIG. 2, the fixing device 3 depicted in FIG. 7 includes the fixing sleeve 31, the pressure roller 32, and the pressurization roller 36. The nip formation pad 34 and the planar heater 35 of the fixing device 3 shown in FIG. 7, although they have the shape slightly different from the shape shown in FIG. 2, have a construction and a function equivalent to those of the nip formation pad 34 and the planar heater 35 of the fixing device 30 depicted in FIG. 2. Hence, the identical reference numerals 34 and 35 are assigned to the nip formation pad 34 and the planar heater 35 shown in FIG. 7, respectively. In the fixing device 3, as a sheet Pa is conveyed through the fixing nip N formed between the fixing sleeve 31 and the pressure roller 32 in the sheet conveyance direction C, the fixing sleeve 31 and the pressure roller 32 apply heat and pressure to the sheet Pa, fixing the color toner image on the sheet Pa.

The planar heater 35 is a sheet heat generator constructed of a glass substrate and a resistive element printed thereon. As the pressurization roller 36 presses the thin, tubular fixing sleeve 31 against a heat generation face 35*h* of the planar heater 35 as shown in FIG. 7, the planar heater 35 heats the fixing sleeve 31.

A comparative fixing device incorporating a halogen heater may include a temperature detector, such as a thermostat and a thermistor disposed outside the fixing sleeve 31, which detects the temperature of the fixing sleeve 31 to prevent overheating of the fixing sleeve 31 and thereby attaining safety of the comparative fixing device. Conversely, in the fixing device 3 depicted in FIG. 7, since the pressurization roller 36 is disposed opposite the planar heater 35 via the fixing sleeve 31, a temperature detector for detecting the temperature of the fixing sleeve 31 may not be located outside the fixing sleeve 31.

Figure 10:
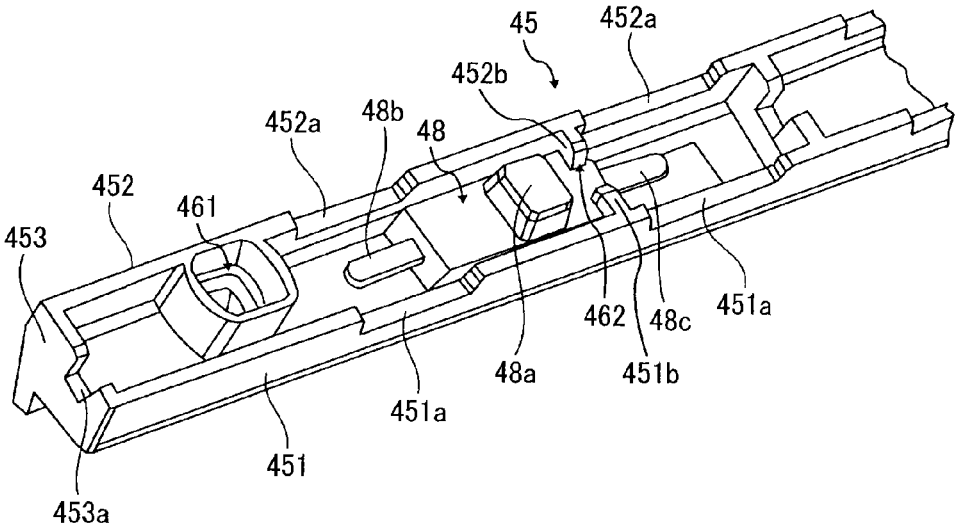
FIG. 10 is a partial perspective view of the housing shown in FIG. 8 and a thermostat mounted on the housing.

To address this circumstance, a temperature detector or a temperature sensor for detecting the temperature of the planar heater 35 to prevent overheating of the fixing sleeve 31 (e.g., the temperature detector 37 depicted in FIG. 2 and the thermostat 48 depicted in FIG. 10) is secured inside the loop formed by the fixing sleeve 31 such that, even if load is imposed to the temperature detector 37 or the thermostat 48, the temperature detector 37 or the thermostat 48 is positioned with respect to the planar heater 35 precisely. For example, a housing 45 situated inside the loop formed by the fixing sleeve 31 mounts or houses the temperature detector 37 or the thermostat 48 that detects the temperature of the planar heater 35 as shown in FIG. 10. As shown in FIG. 7, the housing 45 is interposed between the planar heater 35 and a stay 39 situated inside the loop formed by the fixing sleeve 31 and supporting the nip formation pad 34. The housing 45 contacts an inner face 35*i* of the planar heater 35 opposite the heat generation face 35*h*. The stay 39 includes a guide 391, a nip formation pad support 392, and a housing mount 393. The guide 391 has a resilience to retain a tubular shape of the fixing sleeve 31 and guide the fixing sleeve 31 rotating in the rotation direction E by contacting the inner circumferential surface of the fixing sleeve 31. The nip formation pad support 392 contacts and supports the planar nip formation pad 34. The housing mount 393 presses against the housing 45.

With reference to FIGS. 8 to 11, a description is provided of a shape and a construction of the housing 45.

Figure 8:
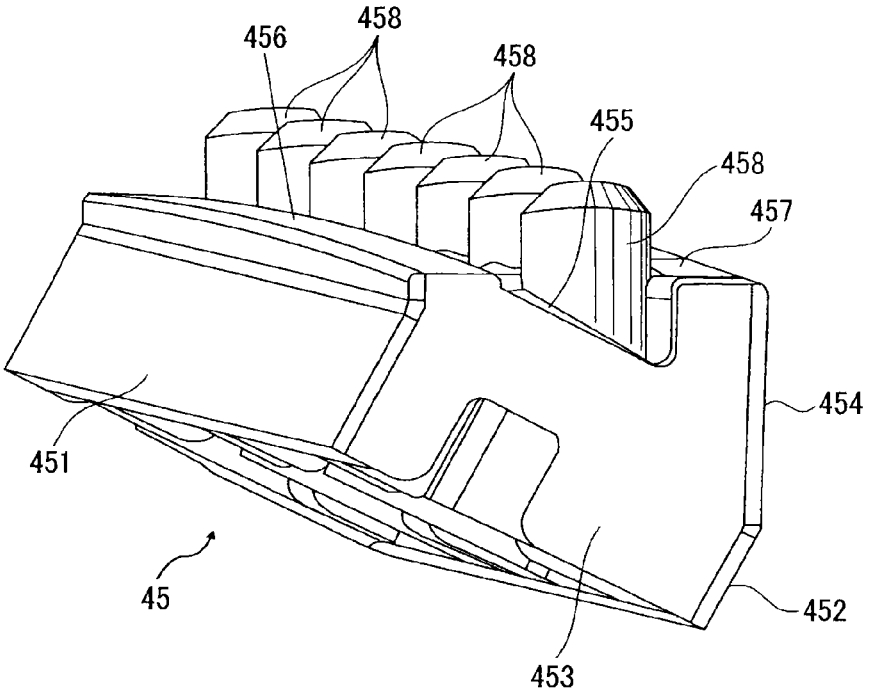
FIG. 8 is a perspective view of a housing incorporated in the fixing device shown in FIG. 7.
Figure 9:
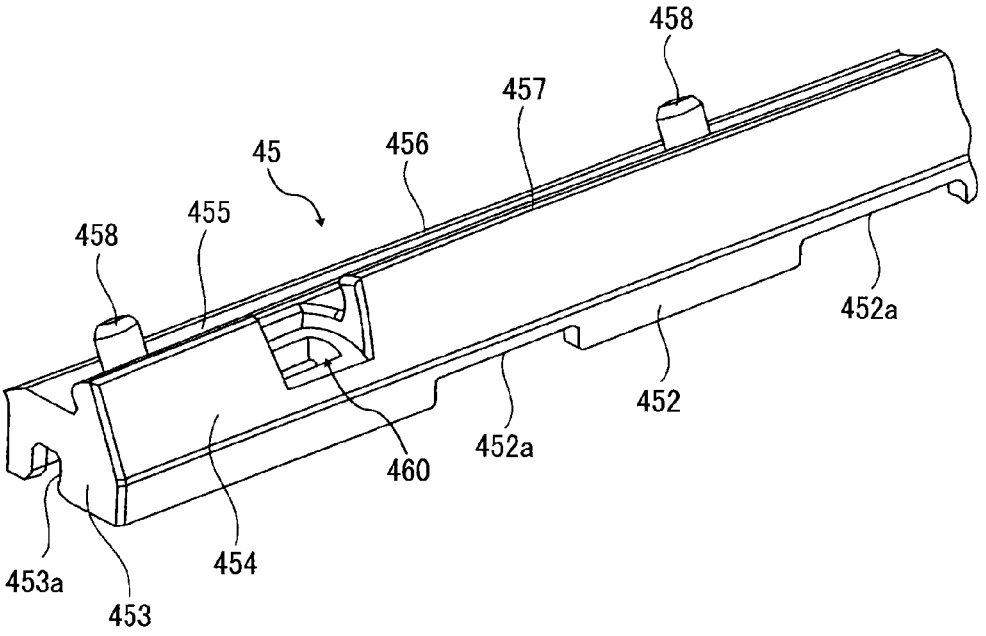
FIG. 9 is a partial perspective view of the housing shown in FIG. 8 illustrating a side disposed opposite a stay incorporated in the fixing device shown in FIG. 7.
Figure 11:
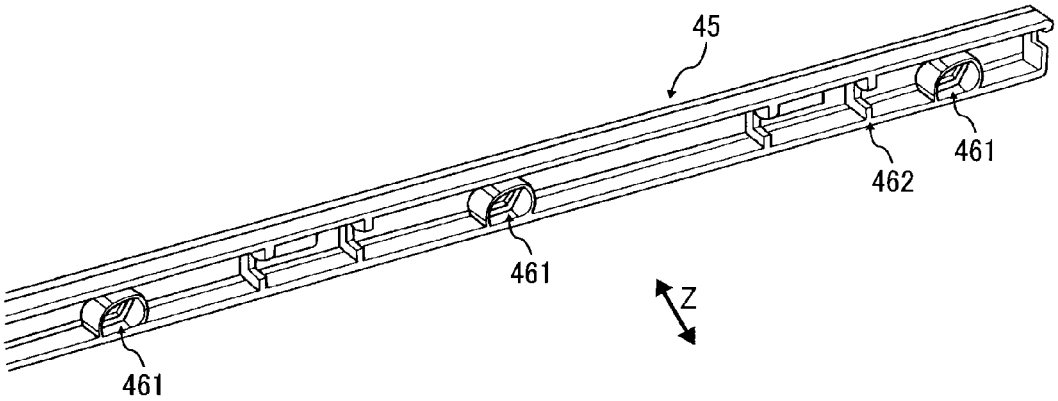
FIG. 11 is a partial perspective view of the housing shown in FIG. 10 in a state in which the thermostat is not mounted on the housing.

FIG. 8 is a perspective view of the housing 45 illustrating a side disposed opposite the stay 39 depicted in FIG. 7. FIG. 8 is an entire perspective view of the housing 45 seen at an angle different from that in FIG. 7 with a substantially reduced length in a longitudinal direction thereof. FIG. 9 is a partial perspective view of the housing 45 illustrating a part in the longitudinal direction thereof illustrating an upper face of the housing 45 without reduction. FIG. 10 is a partial perspective view of the housing 45 illustrating a part in the longitudinal direction thereof illustrating a lower face of the housing 45 opposite the upper face thereof shown in FIG. 9. FIG. 11 is a partial perspective view of the housing 45 illustrating a side disposed opposite the planar heater 35 depicted in FIG. 7.

As shown in FIG. 8, the housing 45 is an elongated platform with an open bottom. The housing 45 includes a front wall 451 extending in the longitudinal direction of the housing 45; a rear wall 452 extending in parallel with the front wall 451 in the longitudinal direction of the housing 45; both side walls 453 disposed at both lateral ends of the housing in the longitudinal direction thereof; a slope 454 angled relative to the rear wall 452 and extending from the rear wall 452 contiguously upward in FIG. 8; and an upper face 455. A first abutment face 456 extending in the longitudinal direction of the housing 45 bridges the upper face 455 and the front wall 451 and projects from the upper face 455. The first abutment face 456 is rounded or curved gently from each lateral end to a center of the housing in the longitudinal direction thereof to project toward the stay 39.

A second abutment face 457 extending in the longitudinal direction of the housing 45 is a plane bridging the upper face 455 and the slope 454 and situated above the first abutment face 456. Cylindrical positioning projections 458 aligned on the upper face 455 in the longitudinal direction of the housing 45 are interposed between the first abutment face 456 and the second abutment face 457. The positioning projections 458 are parallel to the slope 454.

Although FIG. 8 illustrates the seven positioning projections 458 as if adjacent positioning projections 458 thereof are close to each other, a predetermined interval is provided between the adjacent positioning projections 458 in the longitudinal direction of the housing 45 as shown in FIG. 9.

As shown in FIG. 10, the open bottom defined by the front wall 451, the rear wall 452, and the side walls 453 includes notches 451*a* produced in the front wall 451, notches 452*a* produced in the rear wall 452, and notches 453*a* produced in the side walls 453, respectively, which secure the housing 45 inside the fixing device 3.

As shown in FIG. 9, a notch 460 for a shoulder screw described below is produced in the slope 454. A plurality of notches 460 is aligned in the longitudinal direction of the housing 45 with an interval between adjacent notches 460 of the plurality of notches 460.

As shown in FIG. 10, the open bottom accommodates a housing positioner 461 formed in an elliptical short tube having a decreased height in a direction orthogonal to the longitudinal direction of the housing 45 and corresponding to the notch 460 depicted in FIG. 9. As shown in FIG. 11, the housing positioners 461 are aligned in the longitudinal direction of the housing 45 with an interval between adjacent housing positioners 461 thereof. A thermostat holder 462 serving as a temperature detector holder is interposed between the adjacent housing positioners 461. As shown in FIG. 10, the thermostat holder 462 is constructed of the front wall 451, the rear wall 452, a restraint 451*b* projecting from the front wall 451 in a width direction orthogonal to the longitudinal direction of the housing 45, and a restraint 452*b* projecting from the rear wall 452 in the width direction of the housing 45. As the thermostat 48 engages the thermostat holder 462, the thermostat 48 is mounted on the housing 45 stationarily. The thermostat 48 serves as a temperature detector that detects the temperature of the planar heater 35. The thermostat 48 includes a contact 48*a* to come into contact with the planar heater 35 and a pair of electrodes 48*b* and 48*c*.

Figure 12:
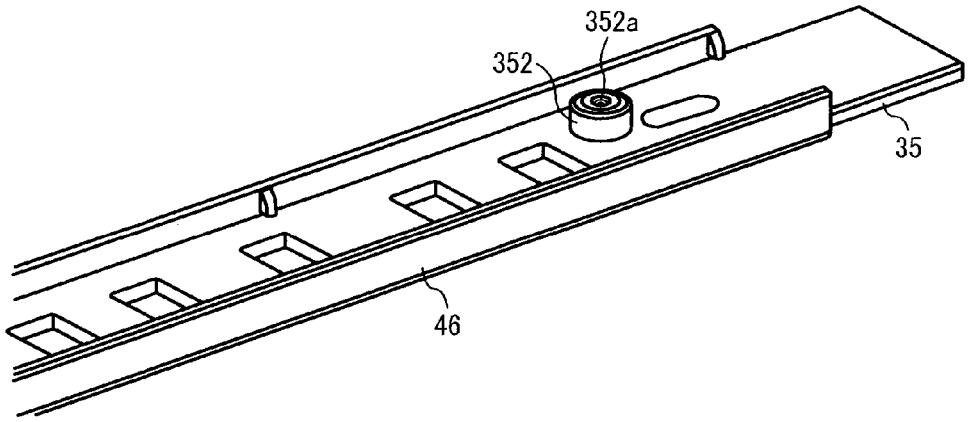
FIG. 12 is a partial perspective view of the planar heater and a heater holder incorporated in the fixing device shown in FIG. 7.
Figure 13:
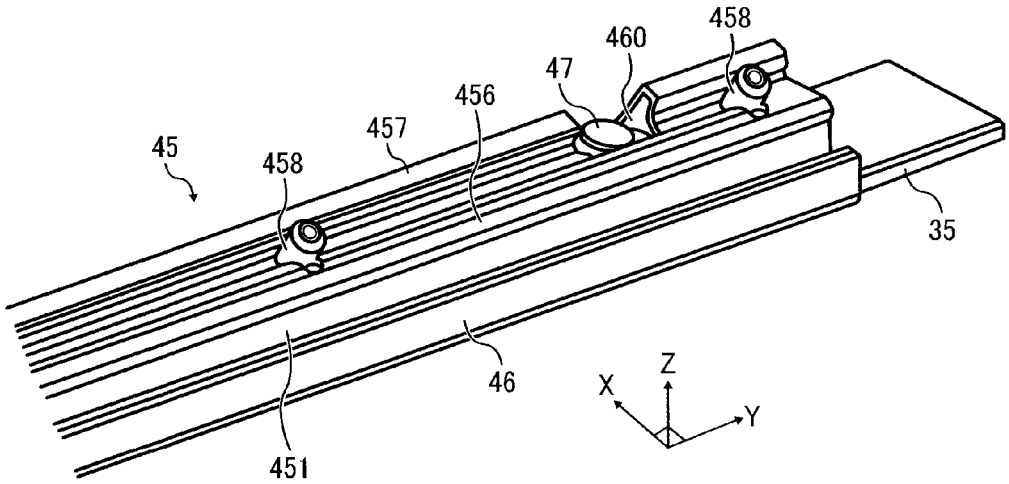
FIG. 13 is a partial perspective view of the heater holder shown in FIG. 12 that is attached with the housing shown in FIG. 10.
Figure 14:
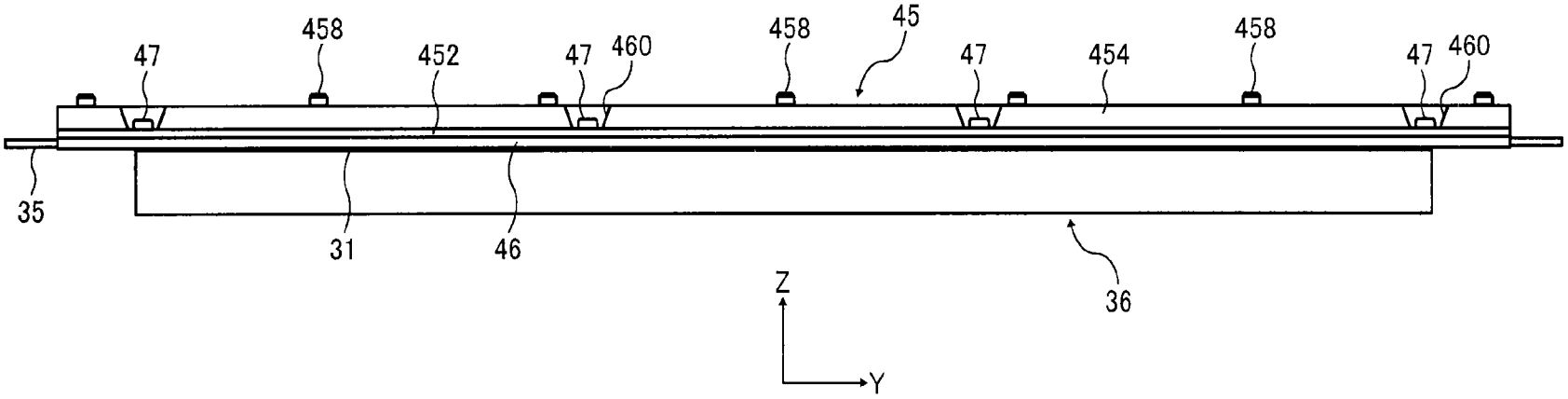
FIG. 14 is a side view of a pressurization roller and the housing incorporated in the fixing device shown in FIG. 7.

With reference to FIGS. 12 to 14, a description is provided of attachment of a heater holder 46 and the planar heater 35 to the housing 45.

FIG. 12 is a partial perspective view of the planar heater 35 and the heater holder 46. FIG. 13 is a partial perspective view of the heater holder 46 and the housing 45 attached to the heater holder 46. FIG. 14 is a side view of the pressurization roller 36 and the housing 45.

As shown in FIG. 12, the planar heater 35 is mounted on and supported by the channel heater holder 46. For example, the planar heater 35 may be molded with the heater holder 46. As shown in FIG. 7, the heater holder 46 is situated inside the loop formed by the fixing sleeve 31 to hold the planar heater 35. As shown in FIG. 12, the heater holder 46 mounts and holds the planar heater 35 and includes a heater positioner 352 (e.g., a boss) mounted on an inner face of the heater holder 46 and disposed opposite the housing positioner 461 of the housing 45 shown in FIG. 10. The heater positioner 352 includes a screw hole 352*a* produced at a center thereof.

As the heater holder 46 is attached to the open bottom of the housing 45, that is, as the heater positioner 352 of the heater holder 46 engages the housing positioner 461 of the housing 45, the housing 45 is positioned with respect to the heater holder 46 directly through the heater positioner 352.

As shown in FIG. 13, the housing 45 is fastened and secured to the planar heater 35 with a fastener, that is, a shoulder screw 47. For example, the shoulder screw 47 is screwed into the screw hole 352*a* of the heater positioner 352 depicted in FIG. 12 through the notch 460 of the housing 45.

Thus, the housing 45 is positioned with respect to the planar heater 35 three-dimensionally in a short direction X, a longitudinal direction Y, and a thickness direction Z of the planar heater 35. The shoulder screw 47 is used to secure the housing 45 to the planar heater 35 in the thickness direction Z to facilitate thermal expansion of the housing 45 in the longitudinal direction Y as the housing 45 is heated by the planar heater 35. Accordingly, error accumulation is suppressed, positioning the thermostat 48 mounted on the housing 45 with respect to the planar heater 35 precisely.

The housing 45 attached with the heater holder 46 mounting the planar heater 35 is attached to and supported by the stay 39 depicted in FIG. 7. The plurality of positioning projections 458, for example, the seven positioning projections 458 according to this exemplary embodiment as shown in FIG. 8, of the housing 45 is inserted into slots 393*a* produced in the housing mount 393 of the stay 39 depicted in FIG. 7, respectively. The first abutment face 456 and the second abutment face 457 of the housing 45 contact the housing mount 393 of the stay 39, positioning the housing 45 with respect to the stay 39 in the longitudinal direction, the width direction, and a height direction of the housing 45. The housing 45 is fastened to the stay 39 with a fastener.

As shown in FIG. 7, the fixing sleeve 31 serving as a thin, elastic tubular fixing rotator is installed inside the fixing device 3 such that the fixing sleeve 31 surrounds the guide 391 of the stay 39, the planar heater 35 attached to the housing 45, and the nip formation pad 34 supported by the stay 39. The pressure roller 32 disposed opposite the nip formation pad 34 via the fixing sleeve 31 presses the fixing sleeve 31 against the nip formation pad 34 to form the fixing nip N between the pressure roller 32 and the fixing sleeve 31. The pressurization roller 36 presses the fixing sleeve 31 against the planar heater 35 to allow the planar heater 35 to heat the fixing sleeve 31.

FIG. 14 illustrates a long length of the planar heater 35 attached to the housing 45 and the pressurization roller 36 pressing the fixing sleeve 31 against the planar heater 35. As shown in FIG. 14, a long length of the housing 45 is not smaller than a long length of the pressurization roller 36 that presses the fixing sleeve 31 against the planar heater 35. Accordingly, even when the planar heater 35 receives pressure from the pressurization roller 36, the housing 45 supports the planar heater 35 against the pressure from the pressurization roller 36 throughout a span greater than a load span where the pressure from the pressurization roller 36 imposes load to the planar heater 35, thus preventing abnormal deformation of a lateral end of the planar heater 35 in the longitudinal direction Y thereof. Consequently, the housing 45 prevents deformation of the planar heater 35 and retains the thermostat 48 carried by the housing 45 with respect to the planar heater 35 precisely.

As shown in FIG. 7, the housing 45 is supported by the stay 39 that supports the nip formation pad 34 against load imposed by the pressure roller 32 and the housing 45 against load imposed by the pressurization roller 36. The stay 39 may be bent by load imposed by the pressurization roller 36. To address this circumstance, as shown in FIG. 7, the housing 45 includes the first abutment face 456 in contact with the housing mount 393 of the stay 39. As shown in FIG. 8, the first abutment face 456 is curved gently from each lateral end to the center of the housing 45 in the longitudinal direction thereof to project toward the stay 39.

Accordingly, even if the stay 39 is bent, the curved first abutment face 456 of the housing 45 offsets bending of the stay 39 at an interface between the housing 45 and the planar heater 35, producing the planar interface between the housing 45 and the planar heater 35. Consequently, the housing 45 offsets deformation of the stay 39, retaining the thermostat 48 housed in the housing 45 with respect to the planar heater 35 precisely. Additionally, the housing 45 prevents deformation and resultant damage of the planar heater 35.

As shown in FIG. 10, the housing 45 accommodates the thermostat 48 serving as a temperature detector. Alternatively, the housing 45 may accommodate a thermistor serving as a temperature detector. In either case, the thermostat 48 and the thermistor should be insulated. Since the housing 45 is also susceptible to overheating as it is heated by the planar heater 35, the housing 45 is curved or rounded, thus being formed in a complicated shape. To address this circumstance, the housing 45 is made of resin resistant against temperatures not smaller than about 200 degrees centigrade, such as polyphenylene sulfide (PPS), liquid crystal polymer (LCP), polyamide imide (PAI), polyether ketone (PEK), polyetheretherketone (PEEK), and polyimide (PI). Even if the housing 45 overheats, the thermostat 48 and the thermistor attain insulation.

In the fixing device 3, the housing 45 accommodating a temperature detector, that is, the thermostat 48 for detecting the temperature of the planar heater 35, and being installable inside the fixing sleeve 31 readily positions the thermostat 48 with respect to the planar heater 35 precisely. As shown in FIG. 1, the image forming apparatus 1 incorporates the image forming device 2 and the fixing device 3. As the sheet Pa bearing the toner image formed by the image forming device 2 is conveyed through the fixing nip N formed between the fixing sleeve 31 and the pressure roller 32 of the fixing device 3, the fixing device 3 fixes the toner image on the sheet Pa.

Figure 15:
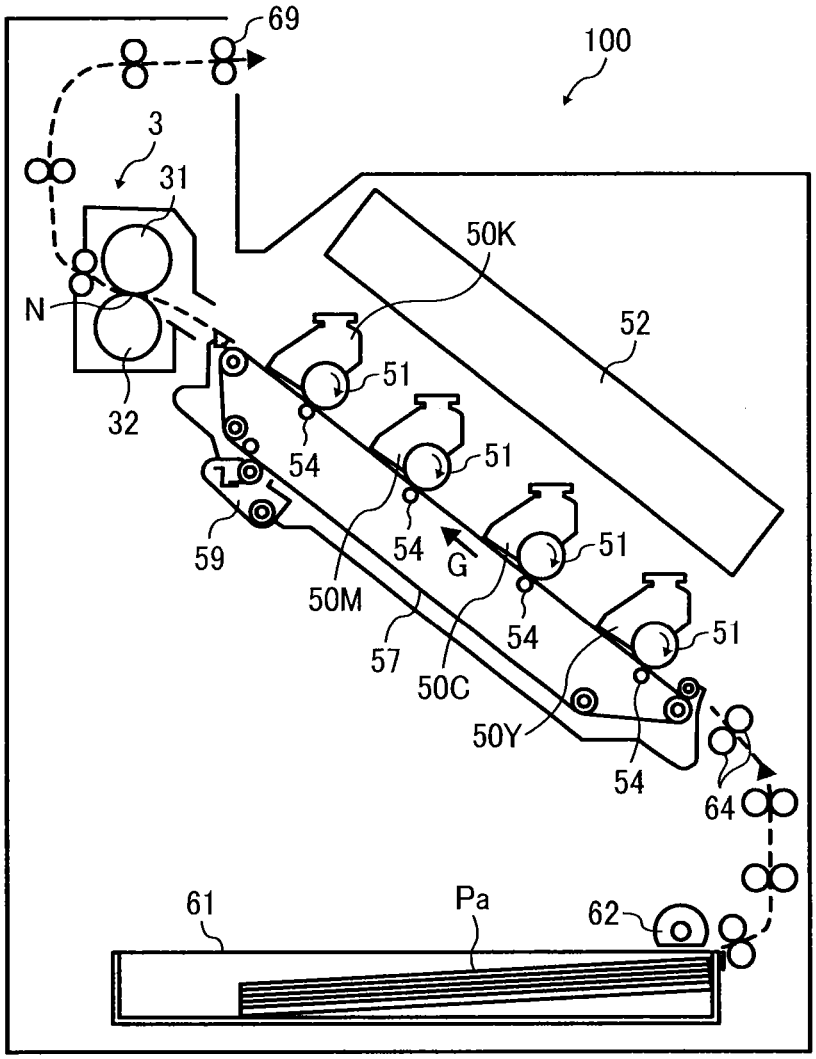
FIG. 15 is a schematic vertical sectional view of an image forming apparatus according to another exemplary embodiment.

With reference to FIG. 15, a description is provided of an image forming apparatus 100 incorporating the fixing device 3.

FIG. 15 is a schematic vertical sectional view of the image forming apparatus 100 that forms a toner image on a sheet Pa by electrophotography. The image forming apparatus 1 shown in FIG. 1 is a monochrome printer that forms a monochrome toner image on a sheet Pa. Conversely, the image forming apparatus 100 shown in FIG. 15 is a color printer that forms a monochrome toner image and a color toner image on a sheet Pa by transferring yellow, cyan, magenta, and black toner images on the sheet Pa directly.

Since the image forming apparatus 100 includes the fixing device 3 depicted in FIG. 7, the identical reference numeral 3 assigned to the fixing device 3 shown in FIG. 7 is assigned to the fixing device 3 shown in FIG. 15.

As shown in FIG. 15, the image forming apparatus 100 includes four process cartridges 50Y, 50C, 50M, and 50K, serving as an image forming device for forming a toner image, aligned along a transfer belt 57 with an identical interval between two adjacent process cartridges of the four process cartridges 50Y, 50C, 50M, and 50K. Each of the four process cartridges 50Y, 50C, 50M, and 50K includes a photoconductive drum 51 serving as an image carrier that carries an electrostatic latent image and a resultant toner image, a charger equivalent to the charging roller 18 shown in FIG. 1, a development device equivalent to the development device 22 depicted in FIG. 1, and a cleaner equivalent to the cleaner 24 depicted in FIG. 1. For example, the development devices visualize electrostatic latent images formed on the photoconductive drums 51 charged by the chargers into yellow, cyan, magenta, and black toner images, respectively. As a sheet Pa is conveyed by the transfer belt 57 rotating in a rotation direction G, four transfer bias rollers 54 disposed opposite the four photoconductive drums 51 via the transfer belt 57 transfer the yellow, cyan, magenta, and black toner images formed on the photoconductive drums 51 onto the sheet Pa such that the yellow, cyan, magenta, and black toner images are superimposed on a same position on the sheet Pa.

The transfer belt 57 is an endless belt made of resin such as polyimide (PI), polyvinylidene difluoride (PVDF), ethylene tetrafluoroethylene (ETFE), and polycarbonate (PC). The transfer belt 57 is stretched taut across and supported by a plurality of rollers and rotatable counterclockwise in FIG. 15 in the rotation direction G to convey the sheet Pa.

A description is provided of image forming processes of the image forming apparatus to form a color toner image on a sheet Pa.

The four photoconductive drums 51 of the four process cartridges 50Y, 50C, 50M, and 50K, respectively, rotate clockwise in FIG. 15. In each of the process cartridges SOY, 50C, 50M, and 50K, the charger charges an outer circumferential surface of the photoconductive drum 51 at a charging position thereon disposed opposite the charger. An exposure device 52 (e.g., an optical writer) emits a laser beam onto the charged outer circumferential surface of the photoconductive drum 51 according to image data of a corresponding color, that is, yellow, cyan, magenta, or black. Thus, the exposure device 52 exposes the charged outer circumferential surface of the photoconductive drum 51, forming an electrostatic latent image for the corresponding color on the photoconductive drum 51.

As the electrostatic latent image formed on the photoconductive drum 51 reaches a development position disposed opposite the development device, the development device supplies toner in the corresponding color to the electrostatic latent image, visualizing the electrostatic latent image into a toner image in the corresponding color. Thereafter, the toner image formed on the photoconductive drum 51 reaches a transfer position disposed opposite the transfer belt 57.

A feed roller 62 picks up and feeds an uppermost sheet Pa of a plurality of sheets Pa loaded on a paper tray 61 to a registration roller pair 64 through a conveyance path. The registration roller pair 64 is situated upstream from the process cartridge 50Y that forms the yellow toner image in a sheet conveyance direction. The registration roller pair 64 conveys the sheet Pa to the transfer belt 57 at a predetermined time. The sheet Pa is attracted to the transfer belt 57 and conveyed by the transfer belt 57 rotating in the rotation direction G. As the sheet Pa moves under the four photoconductive drums 51, the yellow, cyan, magenta, and black toner images formed on the photoconductive drums 51 are transferred onto the sheet Pa successively in this order such that the yellow, cyan, magenta, and black toner images are superimposed on the same position on the sheet Pa. Thus, a color toner image is formed on the sheet Pa.

For example, the transfer bias rollers 54 disposed opposite the photoconductive drums 51 via the transfer belt 57 transfer the yellow, cyan, magenta, and black toner images from the photoconductive drums 51 onto the sheet Pa, respectively. As each of the transfer bias rollers 54 is applied with a transfer voltage having a polarity opposite a polarity of toner of the toner image on the photoconductive drum 51, the transfer bias roller 54 transfers the toner image onto the sheet Pa.

Thereafter, the sheet Pa bearing the color toner image is separated from the transfer belt 57 and conveyed to the fixing device 3. In the fixing device 3, as the sheet Pa is conveyed through the fixing nip N formed between the fixing sleeve 31 and the pressure roller 32, the fixing sleeve 31 and the pressure roller 32 apply heat and pressure to the sheet Pa, fixing the color toner image on the sheet Pa. After being discharged from the fixing device 3, the sheet Pa is discharged onto an outside of the image forming apparatus 100 by an output roller pair 69. On the other hand, after the sheet Pa separates from the transfer belt 57, a belt cleaner 59 cleans an outer circumferential surface of the transfer belt 57 moving under the belt cleaner 59. Thus, a series of image forming processes performed by the image forming apparatus 100 is completed.

The image forming apparatus 100 incorporating the fixing device 3 is warmed up quickly, saving energy. In the fixing device 3, the housing 45 accommodating the thermostat that detects the temperature of the planar heater 35 and being installable inside the fixing sleeve 31 readily retains the thermostat 48 with respect to the planar heater 35 precisely. Accordingly, the planar heater 35 is controlled to heat the fixing sleeve 31 to the fixing temperature precisely, preventing overheating of the fixing sleeve 31 and enhancing safety of the fixing device 3.

The image forming apparatus 100 shown in FIG. 15 is a color printer employing a tandem direct transfer method using the plurality of photoconductive drums 51 from which toner images are transferred onto a sheet Pa directly. Alternatively, the image forming apparatus 100 may be a color printer employing a tandem indirect transfer method using the plurality of photoconductive drums 51 from which toner images are transferred onto an intermediate transferor such as an intermediate transfer belt successively such that the toner images are superimposed on a same position on the intermediate transferor and further transferred from the intermediate transferor onto a sheet Pa collectively. Yet alternatively, instead of a tandem structure in which the stationary development devices are disposed opposite the rotatable photoconductive drums 51, respectively, the image forming apparatus 100 may employ a revolver structure in which a plurality of revolving development devices containing yellow, cyan, magenta, and black toners, respectively, comes into contact with a single photoconductive drum successively.

The image forming apparatuses 1 and 100 incorporate drum-shaped photoconductors, that is, the photoconductive drums 8 and 51. Alternatively, the image forming apparatuses 1 and 100 may incorporate belt-shaped photoconductors.

Like the fixing device 30 depicted in FIG. 2, the fixing device 3 depicted in FIG. 7 may include the power supply 40 and the controller 42 depicted in FIG. 2. Alternatively, the power supply 40 and the controller 42 may be incorporated in the image forming apparatuses 1 and 100 at a position outside the fixing device 3.

A description is provided of advantages of the fixing device 3 described above.

As shown in FIG. 7, the fixing device 3 includes a thin tubular fixing rotator (e.g., the fixing sleeve 31) formed into a loop and rotatable in a predetermined direction of rotation to come into contact with a toner image on a recording medium (e.g., a sheet Pa); a pressure rotator (e.g., the pressure roller 32) pressed against the fixing rotator to form the fixing nip N therebetween; a stay (e.g., the stay 39) pressing against the pressure rotator; a heater (e.g., the planar heater 35) disposed opposite an inner circumferential surface of the fixing rotator to heat the fixing rotator; a pressurization member (e.g., the pressurization roller 36) pressed against the planar heater via the fixing rotator; and a controller (e.g., the controller 42) to control the heater. As the recording medium bearing the toner image is conveyed through the fixing nip N, the fixing rotator and the pressure rotator fix the toner image on the recording medium. The heater includes the planar heater 35 including the heat generation face 35*h* contacting the inner circumferential surface of the fixing rotator and the inner face 35*i* opposite the heat generation face 35*h*. The housing 45 is interposed between the stay and the inner face 35*i* of the planar heater 35. The housing 45 mounts the thermostat 48 that detects the temperature of the planar heater 35.

Accordingly, the housing 45 mounting the thermostat 48 positions and retains the thermostat 48 with respect to the planar heater 35 precisely with simple installation of the housing 45 inside the loop formed by the fixing rotator.

According to the exemplary embodiments described above, the fixing sleeve 31 serves as a fixing rotator. Alternatively, a fixing film, a fixing belt, or the like may be used as a fixing rotator. Further, the pressure roller 32 serves as a pressure rotator. Alternatively, a pressure belt or the like may be used as a pressure rotator.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotator formed into a loop and rotatable in a predetermined direction of rotation;

a pressure rotator disposed outside the loop formed by the fixing rotator and pressed against the fixing rotator to form a fixing nip therebetween through which a recording medium bearing a toner image is conveyed;

a stay disposed opposite the pressure rotator via the fixing rotator;

a heater disposed opposite an inner circumferential surface of the fixing rotator to heat the fixing rotator;

a pressurization member pressed against the heater via the fixing rotator;

a housing interposed between the stay and the heater;

a temperature detector mounted on the housing to detect a temperature of the heater; and a heater holder holding the heater and attached with the housing, wherein the housing includes a plurality of housing positioners aligned in a longitudinal direction of the housing, and wherein each of the plurality of housing positioners includes an elliptical tube having a decreased height in a direction orthogonal to the longitudinal direction of the housing.

2. The fixing device according to claim 1, wherein the heater includes a planar heater including:

a heat generation face contacting the inner circumferential surface of the fixing rotator; and an inner face being opposite the heat generation face and contacting the housing.

3. The fixing device according to claim 1, wherein a long length of the housing is not smaller than a long length of the pressurization member.

4. The fixing device according to claim 1, wherein the stay supports the housing, and wherein the housing includes an abutment face in contact with the stay and curved gently from each lateral end to a center of the housing in a longitudinal direction thereof to project toward the stay.

5. The fixing device according to claim 1, wherein the housing is made of resin resistant against temperatures not smaller than about 200 degrees centigrade.

6. The fixing device according to claim 1, further comprising a nip formation pad interposed between the stay and the fixing rotator and pressing against the pressure rotator via the fixing rotator.

7. The fixing device according to claim 6, wherein the stay includes:

a guide to contact and guide the fixing rotator rotating in the predetermined direction of rotation;

a nip formation pad support contacting and supporting the nip formation pad; and a housing mount pressing against the housing.

8. The fixing device according to claim 7, wherein the stay further includes a plurality of slots penetrating through the housing mount, and wherein the housing includes a plurality of positioning projections projecting toward the stay and being inserted into the plurality of slots of the stay, respectively.

9. The fixing device according to claim 1, wherein the fixing rotator includes one of a fixing sleeve and a fixing belt and the pressure rotator includes a pressure roller.

10. The fixing device according to claim 1, wherein the pressurization member includes a pressurization roller.

11. The fixing device according to claim 1, wherein the temperature detector includes one of a thermistor and a thermostat.

12. The fixing device according to claim 1, wherein the housing includes a temperature detector holder that holds the temperature detector.

13. An image forming apparatus comprising the fixing device according to claim 1.

14. A fixing device comprising:

a fixing rotator formed into a loop and rotatable in a predetermined direction of rotation;

a pressure rotator disposed outside the loop formed by the fixing rotator and pressed against the fixing rotator to form a fixing nip therebetween through which a recording medium bearing a toner image is conveyed;

a stay disposed opposite the pressure rotator via the fixing rotator;

a heater disposed opposite an inner circumferential surface of the fixing rotator to heat the fixing rotator;

a pressurization member pressed against the heater via the fixing rotator;

a housing interposed between the stay and the heater;

a temperature detector mounted on the housing to detect a temperature of the heater; and a heater holder holding the heater and attached with the housing, wherein the housing includes a plurality of housing positioners aligned in a longitudinal direction of the housing, and wherein the housing further includes a temperature detector holder, interposed between adjacent housing positioners of the plurality of housing positioners in the longitudinal direction of the housing, to engage the temperature detector.

15. An image forming apparatus comprising the fixing device according to claim 14.

16. A fixing device comprising:

a fixing rotator formed into a loop and rotatable in a predetermined direction of rotation;

a pressure rotator disposed outside the loop formed by the fixing rotator and pressed against the fixing rotator to form a fixing nip therebetween through which a recording medium bearing a toner image is conveyed;

a stay disposed opposite the pressure rotator via the fixing rotator;

a heater disposed opposite an inner circumferential surface of the fixing rotator to heat the fixing rotator;

a pressurization member pressed against the heater via the fixing rotator;

a housing interposed between the stay and the heater;

a temperature detector mounted on the housing to detect a temperature of the heater; and a heater holder holding the heater and attached with the housing, wherein the housing includes a plurality of housing positioners aligned in a longitudinal direction of the housing, and wherein the heater holder includes a plurality of heater positioners aligned in a longitudinal direction of the heater holder to engage the plurality of housing positioners of the housing, respectively.

17. The fixing device according to claim 16, wherein each of the plurality of heater positioners includes a boss.

18. The fixing device according to claim 16, further comprising a shoulder screw to fasten the housing to the heater to secure the temperature detector mounted on the housing with respect to the heater three-dimensionally in the longitudinal direction, a short direction, and a thickness direction of the heater.

19. The fixing device according to claim 18, wherein each of the plurality of heater positioners includes a screw hole into which the shoulder screw is inserted.

20. An image forming apparatus comprising the fixing device according to claim 16.

* * * * *